United States Patent [19]

Tarpley, Jr.

[11] 4,131,238

[45] Dec. 26, 1978

[54] ULTRASONIC GRINDER

[75] Inventor: William B. Tarpley, Jr., West Chester, Pa.

[73] Assignee: Energy and Minerals Research Co., Kennett Square, Pa.

[21] Appl. No.: 833,632

[22] Filed: Sep. 15, 1977

[51] Int. Cl.[2] ..... B02C 19/18

[52] U.S. Cl. ..... 241/30; 241/1; 241/212; 241/227; 241/260.1; 241/283

[58] Field of Search ..... 241/1, 23, 30, 207, 241/212, 221, 227, 260.1, 283, 301

[56] References Cited

U.S. PATENT DOCUMENTS

| | | | |
|---|---|---|---|
| 3,107,063 | 10/1963 | Nyberg | 241/212 |
| 3,197,147 | 7/1965 | Krohne | 241/227 |
| 3,284,010 | 11/1966 | Bodine, Jr. | 241/1 X |
| 3,473,741 | 10/1969 | Bodine | 241/301 X |
| 3,682,397 | 8/1972 | Bodine | 241/283 X |

*Primary Examiner*—Howard N. Goldberg
*Attorney, Agent, or Firm*—Seidel, Gonda & Goldhammer

[57] ABSTRACT

Materials such as coal, rock, etc. are comminuted by a combination of mechanical comminution forces and ultrasonic vibratory energy which creates cyclic fatigue stresses in the material being treated.

14 Claims, 7 Drawing Figures

FIG. 4
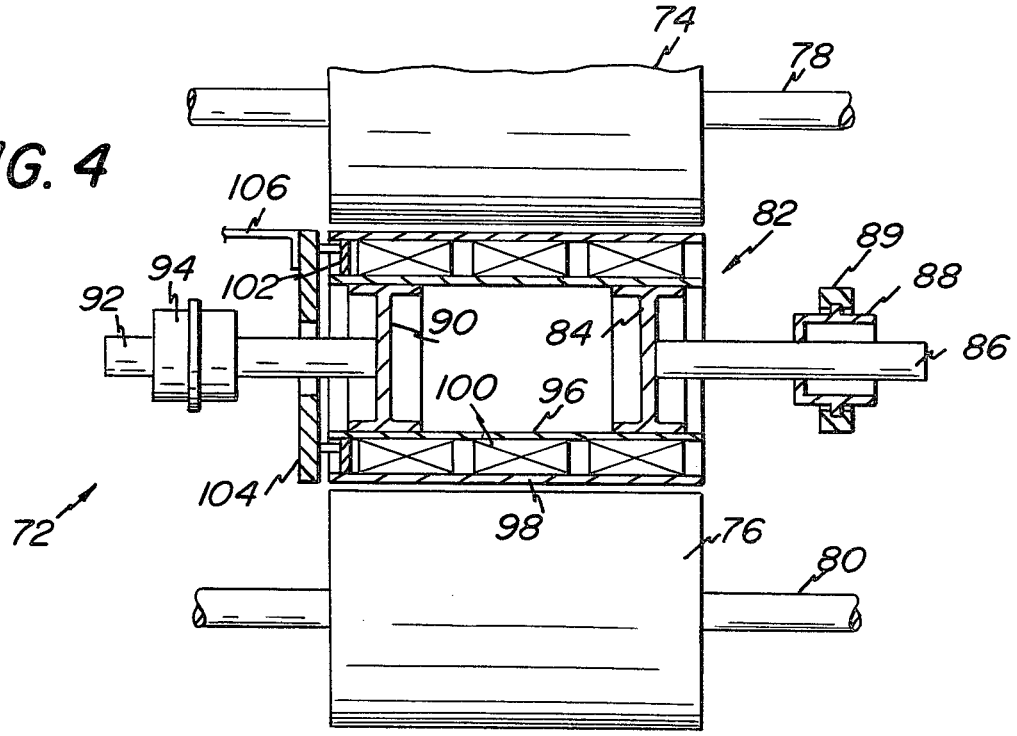
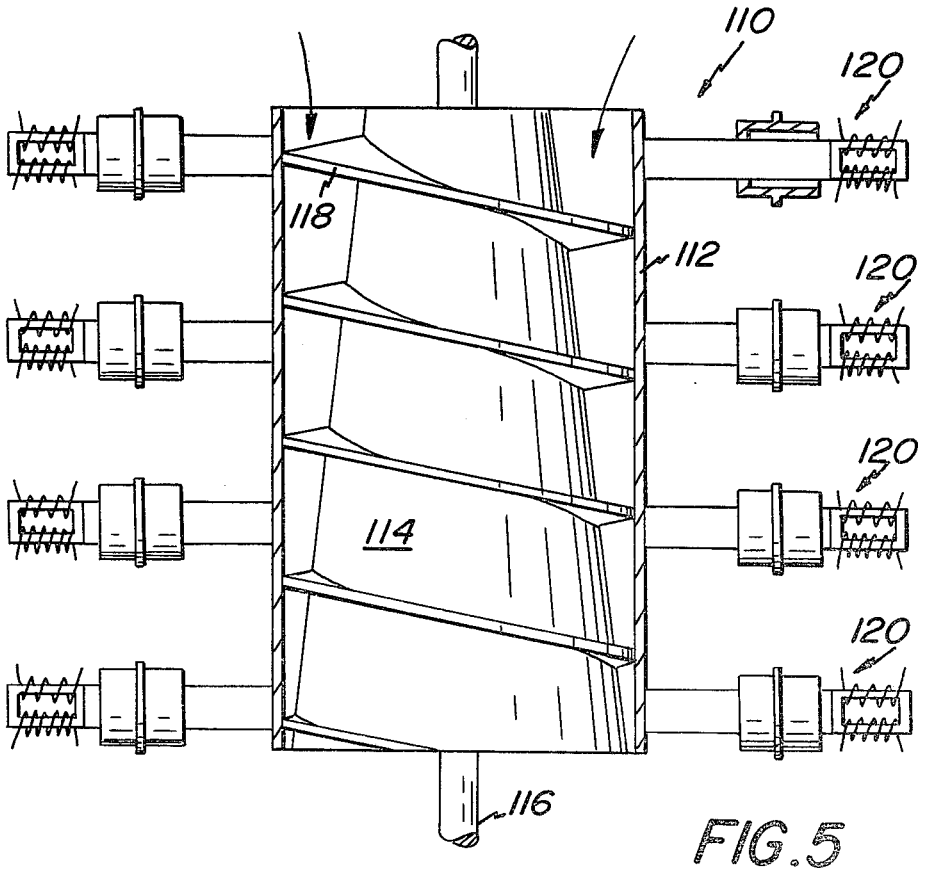
FIG. 5

ULTRASONIC GRINDER

BACKGROUND

Various types of apparatus have been suggested heretofore in connection with comminution of material such as rock, coal, etc. The apparatus suggested heretofore in connection with comminution of coal principally for combustion as powdered coal is very expensive. There is a substantial need for equipment capable of comminuting material such as coal so that it may be comminuted more cheaply while at the same time attaining pulverized coal which can be fed for purposes of combustion. The problem is complicated by recent findings that non-coal mineral content of the coal is very often very finely divided and consequently the coal must be finely comminuted in order that it may be processed to achieve satisfactory purification prior to use as a combustion fuel.

The present invention is directed toward a solution of comminution of material such as coal so as to achieve fine comminution not attainable by conventional apparatus with minimum energy input.

It is known to use sonic energy in connection with the comminution of coal. For example, see U.S. Pat. No. 3,284,010. In said patent, the vibratory energy is used to move at least one of a pair of cooperating elements to mechanically crush the coal. Such a construction is less efficient from an energy standpoint than conventional motor means to move one of the elements. The present invention does not use vibratory energy to effet a mechanical comminution of the coal. Instead, I use vibratory energy to supplement a conventional mechanical comminution so that the coal is subjected to a unique combination of forces.

SUMMARY OF THE INVENTION

Apparatus in accordance with the present invention is capable of comminuting material such as coal, rock, and the like. The apparatus includes first and second elements cooperating to mechanically comminute materials at a nip therebetween. At least one of said elements is resonant. A source of vibratory energy is connected to the resonant element. The source is of sufficient power level so that the vibratory energy transmitted by said one element to the material being treated caues cyclic fatigue stresses in the material while the material is being mechanically comminuted.

The present invention has advantages including an improvement of over-all energy efficiency, attainment a particular particle size not capable of being attained by conventional equipment with the same energy input, and achievement of a comminuted particle size that could not otherwise be readily achieved.

It is an object of the present invention to provide novel apparatus and method for comminuting materials by inducing cyclic fatigue stresses in the material while the material is being mechanically comminuted, while attaining the above-identified advantages.

Other objects will appear hereinafter.

For the purpose of illustrating the invention, there is shown in the drawings a form which is presently preferred; it being understood, however, that this invention is not limited to the precise arrangements and instrumentalities shown.

FIG. 4 is a view similar to FIGS. 2 and 3 but showing another embodiment of the present invention.

FIG. 5 is a vertical sectional view through another embodiment of the present invention.

Figure 1:
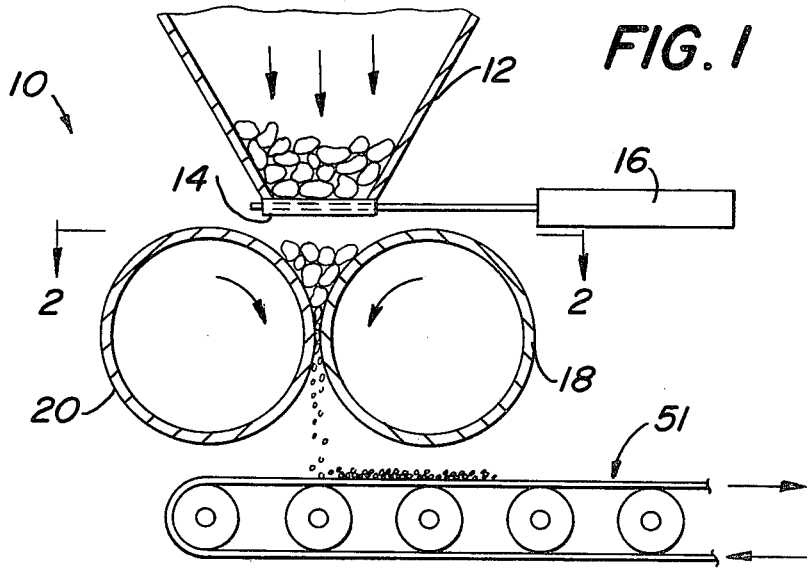
FIG. 1 is a sectional view through an ultrasonic grinder in accordance with the present invention.
Figure 2:
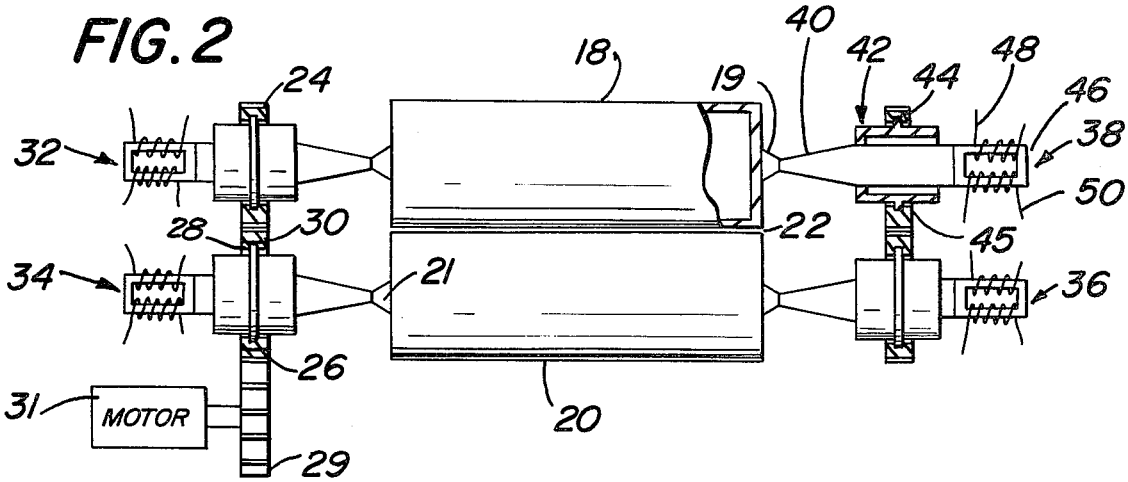
FIG. 2 is a view taken along the line 2—2 in FIG. 1.

Referring to the drawings in detail, wherein like numerals indicate like elements, there is shown apparatus in accordance with the present invention designated generally as 10. The apparatus 10 includes a hopper 12 containing material such as coal, rock or the like to be comminuted. The lower end of the hopper 12 may be provided with a gate valve 14 or the like having a selectively operable actuator 16. Actuator 16 may be a piston-cylinder arrangement of conventional construction.

Below the discharge port of the hopper 14, there is provided a pair of hollow crusher rolls 18 and 20 positioned alongside one another so as to have a nip 22 therebetween. Roll 18 has an axial shaft 19 at each end. Roll 20 has an axial shaft 21 at each end. The rolls 18 and 20 are made from metal such as steel and are dimensioned as to length and thickness so as to be resonant at a predetermined frequency.

A source of vibratory energy 32 is fixedly connected to one end of the shaft 19. A similar source 38 is fixedly connected to the opposite end of shaft 19. Similar sources of vibratory energy 34, 36 are fixedly secured to opposite ends of the shaft 21.

A gear 24 supports energy source 32 and meshes with a gear 26 which supports energy source 34 so that the rolls 18 and 20 may rotate about their longitudinal axes in opposite directions as shown by the curved arrows in FIG. 1. One of the gears such as gear 26 is provided with a bearing 28 mounted within the eccentric bushing 30 so that the longitudinal axis of roll 20 may be adjusted toward and away from roll 18 to vary the size of the nip 22. One of the gears, such as gear 26, is driven by meshing with gear 29 connected to a drive motor 31.

The sources of vibratory energy 32, 34, 36 and 38 are identical and constructed to vibrate the rolls 18, 20 in a complex mode comparable to peristaltic movement while the rolls cooperate with one another to mechanically crush coal or other material at the nip 22. Since the sources are identical, only source 38 will be described in detail.

The source 38 includes a vibration transmission member 40 of metal and of resonant length. Member 40 is preferably tapered as shown with its smaller diameter end fixedly secured to the shaft 19 with a good impedance match such as by welding. The other end of member 40 is fixedly secured to a transducer 46 with a good impedance match such as by welding or brazing. The transducer 46 may comprise a laminated core of nickel or other magnetostrictive elements having a rectangularly shaped opening therein. A polarizing coil 48 is wound through the opening in transducer 46 on one side thereof and an excitation coil 50 is wound through the opening in transducer 46 on the opposite side thereof. Upon variation of the magnetic field strength of the excitation coil 50, there will be produced concomitant variants in the dimensions of the transducer 46, provided that the polarizing coil 48 is charged to a suitable level with DC current, and that the frequency of the aforesaid variations will be equal to the frequency of the alternating electric current flowing in coil 50. Other types of transducers may be used in place of magnetostrictive transducer 46 such as electrostrictive ceramic wafers which are commercially available.

The frequency of vibration may be varied above and below the ultrasonic range. Suitable frequencies may vary from 1000 Hertz to 20,000 Hertz and above. Source 32 is 180° out of phase with source 38 so that roll 18 will be vibrated in a peristaltic mode while being mechanically driven to rotate about its longitudinal axis. Each source of energy has a force-insensitive mount. Member 40 is provided with a force-insensitive mount 42. The force-insensitive mount such as mount 42 facilitates supporting the sources 36 and 38 from trunions 45 and sources 32, 34 from their gears with little or no loss of vibratory energy into the support trunions or the gears. The support trunions for sources 32, 34 and their gears are not shown in the drawing for purposes of simplicity of illustration.

Per se, a force-insensitive mount is known. For example, see U.S. Pat. No. 2,891,178. A force-insensitive mount is a resonant member having a length equivalent to an even multiple of one-quarter wave lengths for the material of which it is made at the frequency of operation of the source to which it is attached. One end of the member 42 is fixedly secured to member 40 at an antinode thereon with the other end being free from attachment. At an odd multiple of the equivalent of one-quarter wave length of the frequency of operation, the mount has a flange 44 extending radially outwardly. The trunion is attached to the flange 44 by way of bearings which facilitate rotation of the source and its associated crushing roll.

When the apparatus 10 is used, coal from the hopper 12 is mechanically crushed as it passes through the nip 22. At the same time, the coal is subjected to vibratory energy from the rolls 18 and 20 and causes cyclic fatigue stresses in the coal. The combination of the mechanical crushing forces and the cyclic fatigue stresses facilitates a much finer comminution of the coal. A conveyor 51 may be provided below the nip 22 so as to receive thereon the comminuted coal for delivery to any suitable place of storage or use. The effect of the vibratory energy in inducing cyclic fatigue stresses may be accentuated by using coal at below room temperature. During winter months, the coal is automatically at a temperature substantially below room temperature. At other times of the year, semi-cryogenic temperatures may be achieved by dry ice or liquid ammonia chilling of the coal. Due to the fine comminution attained, separation of non-coal mineral content such as pyrites is easily attained.

Figure 3:
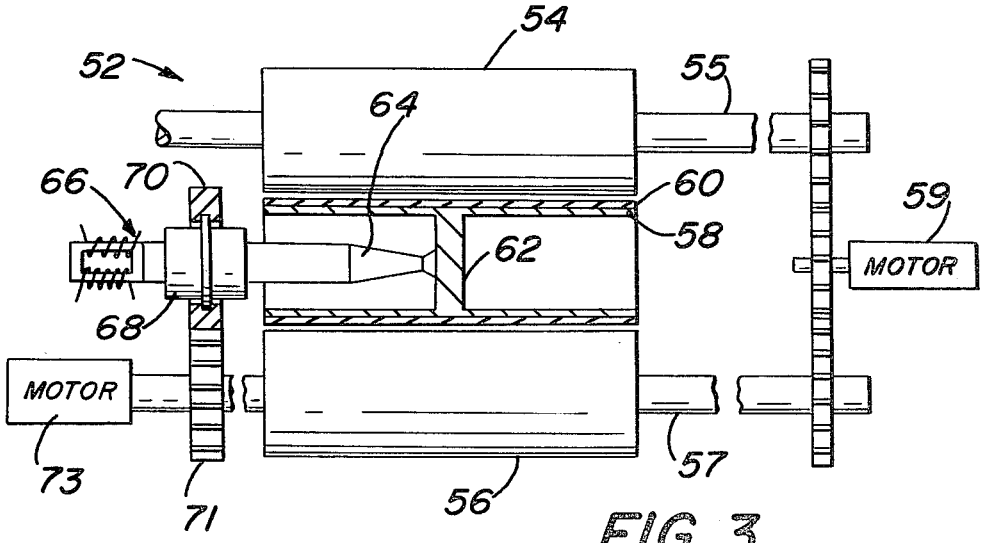
FIG. 3 is a view similar to FIG. 2 but directed to another embodiment of the present invention.

In FIG. 3, there is illustrated another embodiment of the apparatus designated generally as 52. The apparatus 52 is the same as apparatus 10 except as will be made clear hereinafter. Apparatus 52 utilizes a pair of anvil rolls 54, 56 rotated in the same direction by a motor 59 having an output gear meshed with matching gears on the shafts 55, 57. Between the rolls 54, 56, there is provided an ultrasonically activated roll 58 having a hardened metal shell 60 on its outer periphery. The periphery of shell 60 is spaced from the periphery of rolls 54, 56 so as to define a nip therebetween comparable to nip 22.

The roll 58 has a hub 62 to which is axially connected a source of vibratory energy 66. Source 66 includes a vibration transmission member 64 fixedly secured to the hub 60 with a good impedance match such as by welding or brazing. Source 66 is provided with a force-insensitive mount 68 and is otherwise identical with the sources 32–38 described above. The radially outwardly extending flange on the mount 68 is fixedly secured to the ID of a gear 70 meshed with gear 71 on the output end of motor 73. A trunion for supporting the gear 70 is not shown. In this manner, the source 66 may rotate with the roll 58 and vibrate the roll 58 is a peristalic mode as described above. Roll 58 is preferably rotated in a direction opposite from the direction of rotation of the rolls 54, 56.

In FIG. 4, there is illustrated another embodiment of the apparatus designated generally as 72. The apparatus 72 is the same as the apparatus 52 except as will be made clear hereinafter. Anvil rolls 74, 76 are provided on shafts 78, 80, respectively. The shafts 78, 80 are driven by a motor not shown in the same manner as the motor means of apparatus 52 in FIG. 3.

An ultrasonically activated roll 82 is provided between the anvil rolls 74, 76. The roll 82 includes a hub 84 connected to one end of shaft 86. Shaft 86 has a force-insensitive mount 88 supported for rotation about its longitudinal axis by the trunion 89. A second hub 90 is connected to one end of shaft 92. Shaft 92 has a force-insensitive mount 94. The trunion for mount 94 is not shown. The shafts 86, 92 lie along the longitudinal axis of the roll 82.

The roll 82 includes an inner core 96 and an outer core 98 spaced therefrom. In the annular space between the cores 96, 98, there is provided arcuate transducers 100 made in segments and secured to the outer periphery of core 96. The transducers 100 are different from the transducers referred to above in that transducers 100 are designed to vibrate in a radial direction so as to cause the outer core 98 to vibrate in a radial mode. The cores 96, 98 are made of metal dimensioned so as to be resonant in a radial mode at the selected frequency of vibration. Electrical energy is coupled to the transducers 100 by way of slip rings 102 on a support plate 104. Slip rings 102 are connected to a source of potential by connectors 106. Thus, the roll 82 vibrates in a radial mode as compared with roll 58 which vibrates in a longitudinal mode.

In FIG. 5, there is illustrated another embodiment of the present invention wherein the apparatus is designated generally as 110. The apparatus 110 includes a cylindrical member 112 which is dimensioned so as to be resonant in a radial mode. A tapered screw 114 is coaxial in width and disposed within the member 112. A motor not shown rotates shaft 116 on the screw 114 so that it rotates about its longitudinal axis. The screw 114 has a helical screw flight 118. The outer periphery of the screw flight 118 is close to but spaced from the inner periphery of the member 112 and acts as a feed means for feeding coal longitudinally through the member 112. Due to the tapered shape of the screw 114 and the shape of the cylinder 112, there is a mechanical crushing action on the coal as it is forced downwardly by the screw flight 118.

A plurality of sources of vibratory energy 120 are secured to the outer periphery of the cylindrical member 112. Each of the sources 120 are the same as the sources 32–38. The sources 120 are each independently supported on trunions at spaced points around the periphery of the member 112. Like the embodiments described above, the sources 120 are fixedly attached to member 112 thereon with a good impedance match such as by welding or brazing. The sources 120 are preferably provided so as to be diametrically opposite another source on the opposite side of the member 112, and with the oppositely disposed sources being 180° out of phase so as to vibrate the cylindrical member 112 in a radial mode. The nip between the screw 114 and the cylindrical member 112 may be varied by vertical adjustment of one member relative to the other.

Figure 6:
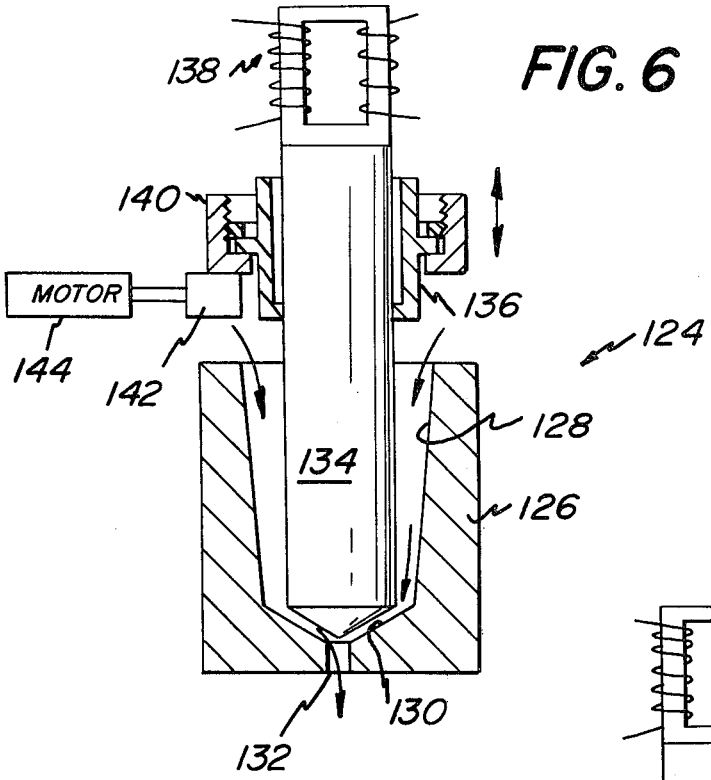
FIG. 6 is a vertical sectional view through another embodiment of the present invention.

In FIG. 6, there is illustrated another embodiment of the present invention wherein the apparatus is designated generally as 124 and is in the form of a stamp crusher. The apparatus 124 includes a vessel 126 having a cavity therein and open at its upper end. The cavity is defined by tapered walls 128, 130 terminating at the discharge port 132 in the bottom of the vessel 126. A stamper 134 is disposed within the cavity and extends thereabove.

The stamper 134 is of metal and dimensioned so as to be resonant in a longitudinal mode. The stamper is connected to a source of vibratory energy 138. Stamper 134 is provided with a force-insensitive mount 136. The radially outwardly directed flange on the mount 136 is attached to a cylindrical support member 140. Member 140 is repetitively moved in a direction corresponding to the double headed arrow by means of a cam 142 eccentrically arranged on an output shaft of motor 144. The direction of movement of coal comminuted by apparatus 124 is indicated by the arrows associated with the vessel 126.

Figure 7:
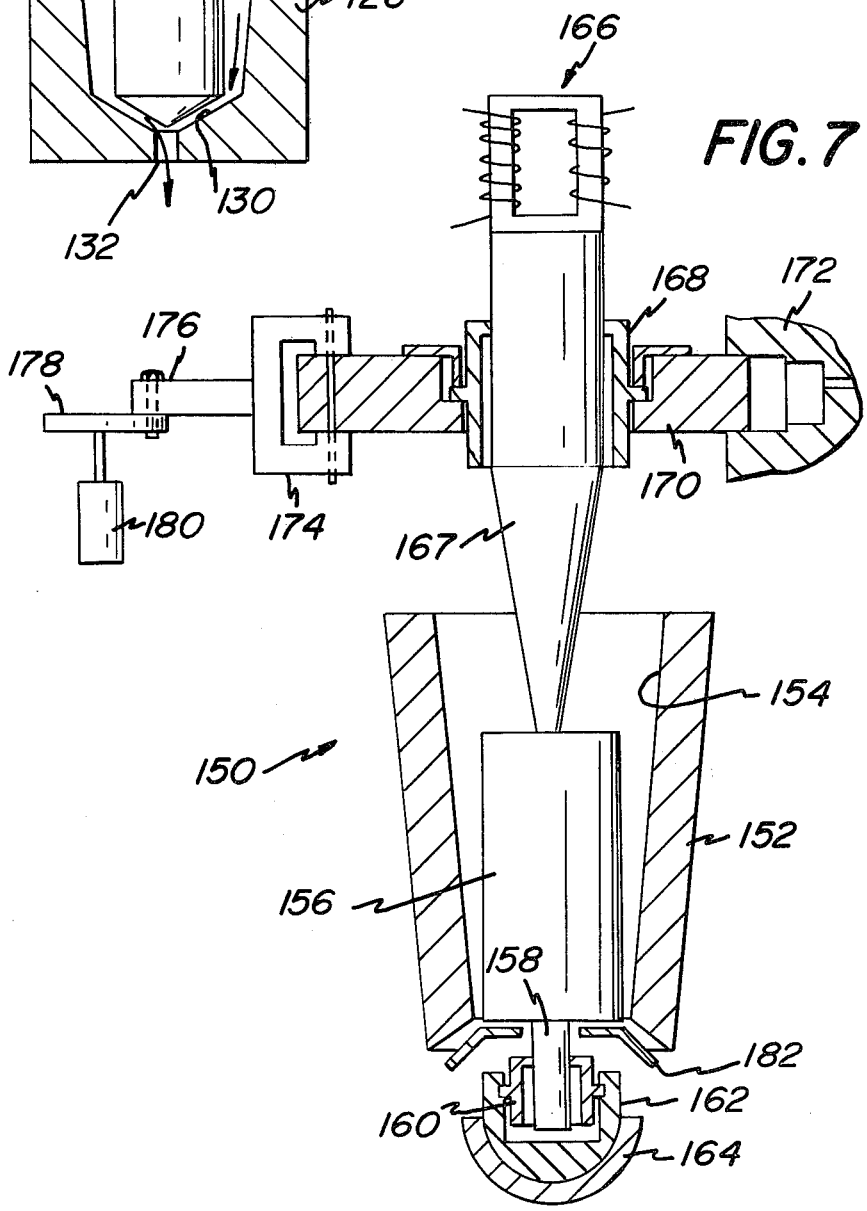
FIG. 7 is a vertical sectional view through another embodiment of the present invention.

In FIG. 7, there is illustrated another embodiment of the apparatus in accordance with the present invention designated generally as 150. The apparatus 150 includes a vessel 152 open at the top and having a uniform tapered cavity 154. Within the cavity 154, there is provided a cylindrical resonant crusher roll 156 having an axially extending shaft 158. The shaft 158 is provided with a force-insensitive mount 160 on a semi-cylindrical bearing 162. The bearing 162 is supported from below by a support 164.

A source of vibratory energy 166 is connected axially to the roll 156 for vibrating roll 156 in a longitudinal mode. The vibration-transmitting member 167 is provided with a force-insensitive mount 168. The radially outwardly directed flange on mount 168 is connected to and supported by a horizontally disposed plate 170. Plate 170 is supported for oscillation by support 172.

A means is provided to oscillate the plate 172 in a direction perpendicular to the longitudinal axis of member 167 and roll 156. Thus, a clevis 174 is pivotably connected by a pin to plate 170. Clevis 174 is connected to by a crank throw 176 and a pivot pin to a disk 178. Disk 178 is rotated by a motor 180.

As motor 180 rotates disk 178, plate 170 is oscillated horizontally. Oscillation of plate 170 causes the roll 156 to gyrate within the cavity 154 while being vibrated in a longitudinal mode by the source 166. The length and dimensions of the roll 156 are chosen so that the roll is resonant in a longitudinal mode.

In connection with the various embodiments of the present invention described above, it will be noted that there is provided first and second elements which cooperate to mechanically comminute material at a nip therebetween. Further, at least one of said elements is resonant. A source of vibratory energy is connected to the resonant element so that the resonant element may transmit vibratory energy to the coal to cause cyclic fatigue stresses in the coal while the coal is being mechanically comminuted. In addition, a motor means separate and apart from the source of vibratory energy is connected to at least one of the cooperating elements for causing relative movement to effect the mechanical comminution. In this manner, the unique interrelationship of mechanical comminution and vibratory energy are utilized to effect comminution in a novel manner while attaining the advantages described above.

While the resonant element in the above-described embodiments is described as being resonant in a longitudinal, radial, or peristaltic mode, it will be apparent that other modes of vibration such as torsional may be used.

The present invention may be embodied in other specific forms without departing from the spirit or essential attributes thereof and, accordingly, reference should be made to the appended claims, rather than to the foregoing specification as indicating the scope of the invention.

I claim:

1. Apparatus for comminuting materials comprising first and second elements cooperating to mechanically comminute materials at a nip therebetween, at least one of said elements is resonant, a source of vibratory energy connected to said resonant element, said source being of sufficient power levels so that vibratory action may be transmitted by said resonant element to the material being comminuted to cause cyclic fatigue stresses in the material while the material is being mechanically comminuted, and motor means separate from said source of vibratory energy, said motor means being connected to said resonant element for causing the mechanical comminution of the material being treated.

2. Apparatus in accordance with claim 1 wherein said source of vibratory energy is connected to said resonant element to vibrate the resonant element in a peristaltic mode.

3. Apparatus in accordance with claim 1 wherein said elements are a pair of parallel rolls, one of said rolls being the resonant roll and the other being an anvil roll, a second anvil roll parallel to said first anvil roll, said resonant roll being between said anvil rolls and parallel thereto.

4. Apparatus in accordance with claim 1 wherein elements are a pair of parallel rolls, one of said rolls being resonant in a radial mode.

5. Apparatus for comminuting materials comprising first and second elements cooperating to mechanically comminute materials at a nip therebetween, said elements being a pair of parallel hollow pressure rolls, at least one of said rolls is resonant, a source of vibratory energy connected to said resonant roll, said source being of sufficient power level so that vibratory energy may be transmitted by said resonant roll to the material being comminuted to cause cyclic fatigue stresses in the material while the material is being mechanically comminuted, and motor means separate from said source of vibratory energy, said motor means being connected to at least one of said rolls for causing relative movement therebetween to effect the mechanical comminution of the material being treated.

6. Apparatus in accordance with claim 5 wherein each of said crusher rolls is resonant in the peristaltic mode, a discrete source of vibratory energy being connected to each end of each crusher roll.

7. Apparatus for comminuting materials comprising first and second elements cooperating to mechanically comminute materials at a nip therebetween, said first element being rotatable within said second element, said second element being resonant, said second element having a cylindrical inner periphery, said first element having a tapered outer periphery, a source of vibratory energy connected to said resonant second element, said source being of sufficient power level so that vibratory energy may be transmitted by said resonant element to the material being comminuted to cause cyclic fatigue stresses in the material while the material is being mechanically comminuted, and motor means separate from said source of vibratory energy, said motor means being connected to at least one of said elements for causing relative movement therebetween to effect the mechanical comminution of the material being treated.

8. Apparatus for comminuting materials comprising first and second elements cooperating to mechanically comminute materials at a nip therebetween, said first element extending downwardly from above into a cavity in said second element, said cavity having a discharge opening adjacent its lower end, at least one of said elements being resonant, a source of vibratory energy connected to said resonant element, said source being of sufficient power level so that vibratory energy may be transmitted by said resonant element to the material being comminuted to cause cyclic fatigue stresses in the material while the material is being mechanically comminuted, and motor means separate from said source of vibratory energy, said motor means being connected to at least one of said elements for causing relative movement therebetween to effect the mechanical comminution of the material being treated.

9. Apparatus in accordance with claim 8 wherein said resonant element is resonant in a longitudinal mode, and said motor means causing said resonant element to move in a direction parallel to its longitudinal axis.

10. Apparatus in accordance with claim 8 wherein said motor means is connected to said resonant element to cause said resonant element to gyrate about a location adjacent one end of said resonant element.

11. A method of comminuting materials such as coal, rock and the like comprising mechanically comminuting material at a nip between first and second cooperating elements one of which is resonant, coupling a motor means to said resonant element for causing relative movement between said elements to effect said mechanical comminution, vibrating said resonant element by a source of vibratory energy discrete from said motor means to cyclicly fatigue stress the material being treated while the material is being mechanically comminuted.

12. A method in accordance with claim 11 including vibrating said resonant element at an ultrasonic frequency.

13. A method in accordance with claim 11 wherein said resonant element is vibrated in a mode which is generally perpendicular to the direction of movement of the material being treated as the material flows through the nip.

14. A method in accordance with claim 11 wherein the temperature of the material being comminuted is below room temperature.

* * * * *